US011463825B2

(12) United States Patent
Kvist

(10) Patent No.: US 11,463,825 B2
(45) **Date of Patent: *Oct. 4, 2022**

(54) MULTIPLE ARM DIPOLE ANTENNA FOR HEARING INSTRUMENT

(71) Applicant: GN HEARING A/S, Ballerup (DK)

(72) Inventor: Soren Kvist, Ballerup (DK)

(73) Assignee: GN HEARING A/S, Ballerup (DK)

( * ) Notice: Subject to any disclaimer, the term of this patent is extended or adjusted under 35 U.S.C. 154(b) by 0 days.

This patent is subject to a terminal disclaimer.

(21) Appl. No.: 16/716,484

(22) Filed: Dec. 16, 2019

(65) Prior Publication Data

US 2020/0221237 A1 Jul. 9, 2020

Related U.S. Application Data

(63) Continuation of application No. 16/158,209, filed on Oct. 11, 2018, now Pat. No. 10,542,356.

(30) Foreign Application Priority Data

Dec. 14, 2017 (EP) ..... 17207363

(51) Int. Cl.
*H04R 25/00* (2006.01)
*H01Q 5/48* (2015.01)
*H01Q 1/27* (2006.01)

(52) U.S. Cl.
CPC ..... *H04R 25/554* (2013.01); *H01Q 1/273* (2013.01); *H01Q 5/48* (2015.01); *H04R 25/558* (2013.01);
(Continued)

(58) Field of Classification Search
CPC .... H04R 25/554; H04R 25/65; H04R 25/658; H04R 2225/021; H04R 2225/51;
(Continued)

(56) References Cited

U.S. PATENT DOCUMENTS 7,548,211 B2 * 6/2009 Platz ..... H04R 25/554 343/718
7,742,614 B2 * 6/2010 Christensen ..... H01Q 9/27 381/324

(Continued)

FOREIGN PATENT DOCUMENTS

CN 103179494 A 6/2013
CN 203289422 U 11/2013

(Continued)

OTHER PUBLICATIONS

Foreign OA for CN Patent Appln. No. 201811526476.3 dated May 18, 2021.

(Continued)

*Primary Examiner* — Huyen D Le
(74) *Attorney, Agent, or Firm* — Vista IP Law Group, LLP

(57) ABSTRACT

A hearing instrument includes: a microphone for providing a first audio signal; a signal processor for processing the first audio signal into a second audio signal compensating a hearing loss of a user of the hearing instrument; a speaker connected to an output of the signal processor for converting the second audio signal into an output sound signal; a wireless communication unit configured for wireless data communication; and an antenna for electromagnetic field emission and/or reception, the antenna having a first antenna element and additional antenna elements, the first antenna element having a first branch and a second branch being connected with the wireless communication unit, the first branch having a first connecting region and the second branch having a second connecting region; wherein one or each of the additional antenna elements interconnects the first connecting region and the second connecting region.

22 Claims, 9 Drawing Sheets

(52) U.S. Cl.
CPC ..... *H04R 25/60* (2013.01); *H04R 25/65* (2013.01); *H04R 2225/51* (2013.01); *H04R 2225/55* (2013.01)

(58) Field of Classification Search
CPC .. H04R 2225/55; H05R 25/558; H01Q 1/243; H01Q 1/273; H01Q 5/48
USPC ..... 381/315, 322, 324, 330, 331; 343/718, 343/866
See application file for complete search history.

(56) References Cited

U.S. PATENT DOCUMENTS

| | | | | |
|---|---|---|---|---|
| 8,565,457 | B2 | 10/2013 | Polinske et al. | |
| 8,699,733 | B2 * | 4/2014 | Polinske | H01Q 1/273 381/315 |
| 9,369,813 | B2 * | 6/2016 | Kvist | H04R 25/554 |
| 9,401,745 | B1 | 7/2016 | Abdulla | |
| 9,554,219 | B2 * | 1/2017 | Kvist | H01Q 9/24 |
| 9,883,295 | B2 * | 1/2018 | Akdeniz | H04R 25/554 |
| 10,542,356 | B2 * | 1/2020 | Kvist | H04R 25/554 |
| 2007/0080889 | A1 * | 4/2007 | Zhang | H01Q 11/08 343/895 |
| 2014/0185848 | A1 | 7/2014 | Özden et al. | |
| 2014/0321685 | A1 | 10/2014 | Rabel | |
| 2015/0131830 | A1 * | 5/2015 | Pinto | H04R 25/55 381/315 |
| 2019/0069101 | A1 * | 2/2019 | Kvist | H04R 25/554 |

FOREIGN PATENT DOCUMENTS

| | | | |
|---|---|---|---|
| CN | 104378134 | A | 2/2015 |
| EP | 2871861 | A1 | 5/2015 |
| EP | 2 986 030 | A1 | 2/2016 |
| EP | 3 028 740 | A1 | 6/2016 |
| EP | 3 242 355 | A1 | 11/2017 |
| JP | H3-114303 | | 5/1991 |
| JP | 2003069332 | A | 3/2003 |
| JP | 2005-347798 | | 12/2005 |
| JP | 2011010017 | | 1/2011 |
| JP | 2014-007504 | | 1/2014 |
| JP | 2014011710 | A | 1/2014 |
| JP | 2015-111824 | | 6/2015 |
| JP | 2015-111825 | | 6/2015 |
| JP | 2015-156634 | | 8/2015 |
| JP | 2016-042691 | | 3/2016 |
| JP | 2016042691 | | 3/2016 |
| JP | 2016-178676 | | 10/2016 |
| JP | 2017-147566 | | 8/2017 |
| JP | 2017 147566 | A | 8/2017 |
| JP | 2018-201080 | | 12/2018 |
| WO | WO2007041835 | A1 | 4/2007 |

OTHER PUBLICATIONS

Translation of May 18, 2021 office action for Chinese Patent Application No. 201811526476.3.
Foreign OA for JP Patent Appln. No. 2018-220689 dated Jul. 27, 2021.
Translation of Foreign OA for JP Patent Appln. No. 2018-220689 dated Jul. 27, 2021.
Extended European Search Report for EP Patent Appln. No. 17207363.7 dated Apr. 6, 2018.
Japanese OA dated Nov. 9, 2021 for Japanese patent application No. 2018-220689 with English translation.

* cited by examiner

MULTIPLE ARM DIPOLE ANTENNA FOR HEARING INSTRUMENT

RELATED APPLICATION DATA

This application is a continuation of U.S. patent application Ser. No. 16/158,209, filed on Oct. 11, 2018, now U.S. Pat. No. 10,542,356, which claims priority to, and the benefit of, European patent application No. EP 17207363.7 filed on Dec. 14, 2017. The entire disclosures of the above applications are expressly incorporated by reference herein.

TECHNICAL FIELD

The present disclosure relates to hearing instruments, such as hearing aids, such as hearing instruments for compensating a hearing loss of a user, particularly hearing instruments having wireless communication capabilities and thus hearing instruments comprising antennas for communication.

BACKGROUND

Hearing instruments have over the later years been increasingly able to communicate with the surroundings, including communicating with remote controls, spouse microphones, other hearing instruments and lately also directly with smart phones and other external electronic devices.

Hearing instruments are very small and delicate devices and to fulfil the above requirements, the hearing instruments need to comprise many electronic and metallic components contained in a housing small enough to fit in the ear canal of a human or behind the outer ear. The many electronic and metallic components in combination with the small size of the hearing instrument housing impose high design constraints on the radio frequency antennas to be used in hearing instruments with wireless communication capabilities. As antennas get small compared to a transceiving wavelength of an electromagnetic field, a fundamental tradeoff between bandwidth and efficiency will arise.

Moreover, antennas, typically radio frequency antennas, in the hearing instruments have to be designed to achieve a satisfactory battery lifetime, good communication for all sizes and shapes of heads, ears and hair, in all environments and with as large frequency bandwidth as possible despite the space limitation and other design constraints imposed by the size of the hearing instrument.

SUMMARY

It is an object to overcome at least some of the disadvantages as mentioned above, and it is a further object to provide a hearing instrument capable of wireless communication.

According to a first aspect, a hearing instrument is provided, the hearing instrument comprising a microphone for reception of sound and conversion of the received sound into a corresponding first audio signal, a signal processor for processing the first audio signal into a second audio signal compensating a hearing loss of a user of the hearing instrument, a speaker connected to an output of the signal processor for converting the second audio signal into an output sound signal, a wireless communication unit configured for wireless data communication and an antenna for emission or reception of an electromagnetic field. The antenna comprises a first antenna element and a plurality of further antenna elements. The first antenna element comprises a first branch and a second branch. The first branch and the second branch are interconnected with the wireless communication unit. The first branch comprises a first connecting region and the second branch comprises a second connecting region. Each of the plurality of further antenna elements interconnects the first connecting region and the second connecting region.

The wireless communication unit is configured for wireless communication, including wireless data communication, and is in this respect interconnected with the antenna for emission and reception of an electromagnetic field. The wireless communication unit may comprise a transmitter, a receiver, a transmitter-receiver pair, such as a transceiver, a radio unit, etc. The wireless communication unit may be configured for communication using any protocol as known for a person skilled in the art, including Bluetooth, including Bluetooth Low Energy, Bluetooth Smart, etc., WLAN standards, manufacturer specific protocols, such as tailored proximity antenna protocols, such as proprietary protocols, such as low-power wireless communication protocols, such as CSR mesh, etc.

The hearing instrument may be any hearing instrument, such as any hearing instrument or hearing aid compensating a hearing loss of a user of the hearing instrument, or such as any hearing instrument providing sound to a user.

In some embodiments, each of the plurality of further antenna elements forms a resonant antenna structure with the first antenna element.

In some embodiments, the plurality of further antenna elements includes at least a second and a third antenna element. Additionally, the plurality of further antenna elements may also include a fourth antenna element, a fifth antenna element etc.

In some embodiments, the first branch has a first feed region being connected to a first feed of the antenna and the second branch has a second feed region being connected to a second feed of the antenna. The first feed region is provided along a first end of the first branch. The second feed region is provided along a first end of the second branch.

In some embodiments, the first branch and second branch of the first antenna element may be connected to the wireless communication unit, both branches being driven conductors.

The first branch and the second branch are interconnected with the wireless communication unit via first and second transmission lines. The first transmission line and the second transmission line may be non-radiating transmission lines. The first transmission line and the second transmission line may be configured so as to minimize electromagnetic radiation emitted from the first and second transmission lines. The first transmission line and the second transmission line may be balanced transmission lines. A current from the wireless communication unit to the first feed of the first branch and a current to the second feed of the second branch may thus have substantially the same magnitude but run in opposite directions, thereby establishing a balanced feed line. It is envisaged that the current magnitudes may not be exactly the same, so that some radiation, though principally unwanted, from the feed line may occur.

The first branch comprises a first connecting region and the second branch comprises a second connecting region. Each of the plurality of further antenna elements interconnects the first connecting region and the second connecting region. The first connecting region may be provided at a second end of the first branch. The second connecting region may be provided at a second end of the second branch.

In some embodiments a first end of at least one of the plurality of further antenna elements, such as a first end of each of the plurality of further antenna elements, is connected to the first connecting region. A second end of the at least one of the plurality of further antenna elements, such as of each of the plurality of further antenna elements, may be connected to the second connecting region. The first antenna element and the at least one of the plurality of further antenna elements may form a loop. Each of the plurality of further antenna elements as connected to the first and second connecting regions of the first antenna element may form a loop.

In some embodiments, the first connecting region is separated from the first feed region by a first distance and the second connecting region is separated from the second feed region by a second distance. The distance may be measured along the antenna element. The first distance and the second distance may be a same distance. The first distance may be similar to, such as having the same length as the second distance. For example, the first distance may correspond to the second distance +/−10%. Alternatively, the first distance may be different from the second distance. In some embodiments the feed regions may coincide with the connecting regions.

The first and the second branch may be similar or identical in form and/or shape, or the first and the second branch may be different in form and/or shape. In some embodiments, the first and the second branch may form a dipole antenna.

In some embodiments the length of the first branch of the first antenna element may correspond to the first distance, such as the distance measured along the first antenna element. The first distance may be measured from the first connecting region to the first feed region, such as from a center of the first connecting region to the center of the first feed region. The length of the second branch of the first antenna element may correspond to the second distance, such as the distance measured along the first antenna element. The second distance may be measured from the second connecting region to the second feed region, such as from a center of the second connecting region to the center of the second feed region.

In some embodiments, the first connecting region is separated from the first feed region by a first distance. The second connecting region may be separated from the second feed region by a second distance, the distance being measured along the antenna element.

Typically, the length of the antenna elements are defined in relation to a wavelength A of the electromagnetic radiation to be emitted from the hearing instrument when it is positioned at its intended operational position at the ear of a user. It should be noted that, for an antenna to be resonant, the length of the resonating element is selected to correspond to a multiple of a quarter-wavelength, $\lambda/4$, of a wavelength A of the electromagnetic radiation to be emitted from the hearing instrument. For an antenna having two branches connected to the wireless communication unit, such as two driven conductors, such as a dipole antenna, typically both branches have a length corresponding to a quarter-wavelength of the electromagnetic radiation to be emitted from the hearing instrument.

The hearing instrument is typically configured to emit and receive electromagnetic radiation within a specific frequency range or band. In some embodiments, the frequency band is provided so as to include a resonance frequency for the antenna elements. Typically, the length of the antenna elements are optimized for use within such specific frequency bands, such as in a band about, or extending from, a peak resonant frequency.

Typically, the length of the antenna elements are selected to optimize the antenna for use at a specific frequency or within a specific frequency band, such as selected to provide an optimum resonance at a specific frequency, such as within a desired frequency band. Typically, the antenna is optimized for ISM bands, including cellular and WLAN bands, such as for GSM bands or WLAN bands.

The frequency band may be a frequency band comprising a frequency selected from the following frequencies, such as comprising 433 MHz, 800 MHz, 915 MHz, 1800 MHz, 2.4 GHz, 5.8 GHz, etc. Thus, the frequency band may be selected as an ISM band, a GSM band or a WLAN band comprising any one or more of these frequencies.

The hearing instruments as disclosed herein may be configured for operation in an ISM frequency band. Preferably, the antenna is configured for operation at a frequency of at least 400 MHz, such as of at least 800 MHz, such as of at least 1 GHz, such as at a frequency between 1.5 GHz and 6 GHz, such as at a frequency between 1.5 GHz and 3 GHz such as at a frequency of 2.4 GHz. The antenna may be optimized for operation at a frequency of between between 400 MHz and 6 GHz, such as between 400 MHz and 1 GHz, between 800 MHz and 1 GHz, between 800 MHz and 6 GHz, between 800 MHz and 3 GHz, etc.

However, it is envisaged that the hearing instrument as herein disclosed is not limited to operation in such a frequency band, and the hearing instrument may be configured for operation in any frequency band.

Thus, in some embodiments, the antenna is configured for emission and reception of an electromagnetic field having a transceiving wavelength, $\lambda$. The first distance and/or the second distance may be between one eighth, ⅛, and three eighths, ⅜ of the transceiving wavelength, $\lambda$. It is well known to the skilled person that the transceiving wavelength in the hearing instrument is dependent on the permittivity of the materials of the hearing instrument.

In some embodiments, the antenna is configured for emission and reception of an electromagnetic field having a transceiving wavelength ($\lambda$). A length of each antenna element may correspond to half a length, $\lambda/2$, of the transceiving wavelength, such as approximately one half of the transceiving wavelength, such as one half +/−10% of the transceiving wavelength, $\lambda$.

In some embodiments, the hearing instrument has a first side and a second side. The first side and the second side may be two opposite sides of the hearing instrument. In some embodiments, the first side may be a side of the hearing instrument being configured to be parallel to a user's head when provided in its intended operational position. The first side may be a side of the hearing instrument adjacent the user's head. For example, the first side may be a longitudinal side of a behind the ear module, and the first side may be the side being adjacent a user's head. Likewise, the first side may be an end face of an in the ear module, and the first side may be the side of the in the ear module facing the inner ear of a user.

The second side may be a side of the hearing instrument furthest from the user's head. For example, the second side may be a longitudinal side of a behind the ear module. The second side may be the side towards the ear lobe of the ear. Likewise, the second side may be an end face of an in the ear module, and the second side may be the side of the in the ear module facing the surroundings of a user. The second side may be a face plate of the in the ear module.

In some embodiments, each of the plurality of further antenna elements, such as the second antenna element, such as the third antenna element, extends from the first side to the second side. Thus, each of the at least second and third antenna elements may extend from the first side to the second side.

The first branch comprises a first connecting region and the second branch comprises a second connecting region and in some embodiments, the first connecting region is provided at the first side of the hearing instrument, and the second connecting region is provided at the second side of the hearing instrument. The first connecting region may be provided at a side opposite of the second connecting region.

Each of the plurality of further antenna elements interconnects the first connecting region and the second connecting region and in some embodiments, each of the plurality of further antenna elements, including the at least second and third antenna elements, extend from the first side to the second side so that at least a first section of each of the further antenna elements, including the at least second and third antenna elements, extends from the first side to the second side of the hearing instrument. A midpoint of each of the further antenna elements, including the at least second and third antenna elements, are provided at the first section of the antenna element extending from the first side to the second side. The midpoint of each of the further antenna elements may be one fourth of the transceiving wavelength, such as approximately one fourth of the transceiving wavelength, such as one fourth +/−10% of the transceiving wavelength (λ) from each connecting region, such as separated by a distance corresponding to one fourth, λ/4, of the transceiving wavelength, λ, such as approximately one fourth of the transceiving wavelength, such as one fourth +/−10% of the transceiving wavelength from each connecting region. The distance and/or wavelength separating the midpoint of each further antenna elements from the first connecting region and/or the second connecting region may be measured along each of the further antenna elements.

In some embodiments, midpoints of the further antenna elements, including at least the second and third antenna elements, are the position from which the distance along each of the further antenna elements, including the at least second and third antenna elements, to the first connecting region and the second connecting region, respectively, is the same. Thus, midpoints of the further antenna elements, are the location, such as the place, such as the point, from which the distance along each of the further antenna elements to the first connecting region and the second connecting region, respectively, is similar, such as approximately the same, such as comparable.

In some embodiments, the antenna is constructed such that, during intended operation, a current running through the antenna has a maximum amplitude in or proximate to the first section of each of the further antenna elements, including the at least second and third antenna elements, extending from the first side to the second side of the hearing instrument during emission of the electromagnetic field. It is an advantage that the current running through the antenna has a maximum amplitude in or proximate to the first sections of each of the further antenna elements extending from the first side to the second side of the hearing instrument during emission of the electromagnetic field since this provides that the maximum, high current part of the antenna structure is arranged in a direction along an ear-to-ear axis of a user, that is such that the high current part of the antenna is arranged in a direction pointing away from the head of a user, such as in a direction perpendicular, or approximately perpendicular, to a side of the head of a user, when the hearing instrument is provided in its intended operational position in the ear or behind the ear of a user. This is advantageous, since it provides an increased electromagnetic field that travels around the head of the user, such as more efficiently around the head of a user, and may thereby provide a wireless data communication that is robust and has low loss.

In some embodiments, the first branch extends along the first side and the first connecting region is provided at the first side and the second branch extends along the second side and the second connecting region may be provided at the second side. The first branch and the second branch of the first antenna element may be extending along opposite sides of the hearing instrument. The first connecting region and the second connecting region of the first antenna element may be provided at opposite sides of the hearing instrument.

In some embodiments, the first branch extending along the first side and the second branch extending along the second side have a similar shape and/or form, such as a meandering shape and/or form, such as geometrical shape and/or form, such as a coiled shape and/or form. The first branch and the second branch may be symmetrical branches, so that the form and/or shape of the first branch corresponds to the form and/or shape of the second branch. Alternatively, the first branch extending along the first side and the second branch extending along the second side may have different, such as dissimilar, such as unlike, shapes and/or forms, such meandering shapes and/or forms, such as geometrical shapes and/or forms, such as coiled shapes and/or forms.

In some embodiments, at least two of the first antenna element, and the plurality of further antenna elements are wrapped into each other, such as arranged alongside each other, such as traced in similar patterns, such as traced in similar patterns alongside each other, such as traced in similar patterns while the further antenna elements maintaining a constant distance, such as a substantial constant distance, between each other, such as rolled together, such as folded into each other. The pattern may be a meandering pattern, a circular pattern, an elliptical pattern, may be any pattern allowing for a compact antenna structure, etc. A compact antenna structure may be an antenna structure reducing the overall size of the antenna structure, preferably reducing the area covered by the antenna structure by 50%, such as by 75% relative to a non-compact, e.g. longitudinal, pattern.

The plurality of further antenna elements includes the at least second and third antenna element. In some embodiments, it is an advantage that at least two of the first antenna element and the plurality of further elements are wrapped into each other since this reduces the size of the antenna. It is a further advantage that current flowing in the wrapped antenna elements may be better aligned and for example current vectors reflecting size and direction of current may be better aligned, thus maximizing the current vector alignment. Additionally, in some embodiments, it is a further advantage that a resonant frequency for the same length of copper trace may be reduced, thus allowing the antenna structure to be small while maintaining a small resonant frequency of the antenna structure, such as the desired, such as the optimal, resonant frequency of the antenna.

In some embodiments, each of the further antenna elements, including the at least second and third antenna elements, has second sections extending from the first connecting region along the first side of the hearing instrument. In some embodiments, each of the further antenna elements, including the at least second and third antenna elements, has third sections extending from the second connecting region along the second side of the hearing instrument.

In some embodiments, the first branch of the first antenna element and the second sections of the further antenna elements, such as the second sections of one or more of the further antenna elements, are arranged in a meandering form and/or shape and/or the second branch of the first antenna element and the third sections of the further antenna elements are arranged in a meandering form and/or shape. In some embodiments, the first branch of the first antenna element and the second sections of the further antenna elements, such as second sections of one or more of the further antenna elements, are arranged in a coiled form, such as a spiral form, such as a helix form, such as a curled form, such as a twirled form, etc. and/or the second branch of the first antenna element and the third sections of the further antenna elements, such as third sections of one or more of the further antenna elements, are arranged in a coiled form, such as a spiral form, such as a helix form, such as a curled form, such as a twirled form, etc. Hereby, the size of the antenna may be reduced. Furthermore, current vectors indicating magnitude and direction of current flowing in the antenna elements may be better aligned, thus maximizing the current vector alignment. Additionally, it may reduce the resonant frequency for the same length of copper trace, thus allowing the antenna structure to be small while maintaining the desired, such as the optimum, resonant frequency of the antenna structure.

The first branch of the first antenna element and the second sections of the plurality of further antenna elements, such as of one or more of the plurality of further antenna elements, may have the same or similar shape and form, including a same or similar length, a same or similar geometry, etc. as the second branch of the first antenna element and the third sections of the plurality of further antenna elements. Alternatively, the first branch of the first antenna element and the second sections of the plurality of further antenna elements, such as of one or more of the further antenna elements, may have a different shape and form, including a dissimilar or unlike length, a dissimilar or unlike geometry, etc. as the second branch of the first antenna element and the third sections of the plurality of further antenna elements.

In some embodiments, the first branch of the first antenna element and the second sections of the further antenna elements, such as second sections of one or more of the further antenna elements, are arranged in a same coiled form, so that the first branch of the first antenna element and the second sections of the further antenna elements, such as of the one or more further antenna elements, trace a same path and/or the second branch of the first antenna element and the third sections of the further antenna elements are arranged in a same coiled form, so that the second branch of the first antenna element and the third sections of the further antenna elements trace a same path. Thus, the path traced by the first branch of the first antenna element and the second sections of the plurality of further antenna elements may be symmetrical to the path traced by the second branch of the first antenna element and the third sections of the plurality of further antenna elements. Hereby, the hearing instrument may emit a substantially same electromagnetic field irrespective of whether the hearing instrument is positioned a right ear or a left ear of a user. Alternatively, the path traced by the first branch of the first antenna element and the second sections of the plurality of further antenna elements may be non-symmetrical to the path traced by the second branch of the first antenna element and the third sections of the plurality of further antenna elements.

In some embodiments, the first branch of the first antenna element and the second sections of the further antenna elements are provided with consistent spacing along at least a part of the path and/or the second branch of the first antenna element and the third sections of the further antenna elements are provided with consistent spacing along at least a part of the path. Hereby, the distance between the elements is constant along at least a part of the length of the sections.

In some embodiments, each of the further antenna elements has approximately a same length, such as a similar length. Alternatively or additionally, the length of each of the further antenna elements, such as the plurality of further antenna elements, including the at least second and third antenna elements, may be slightly different, such as deviate slightly from each other, such as deviating with +/−10%, such as deviating with +/−5%.

In some embodiments, the first section of at least some of the further antenna elements, such as the plurality of further antenna elements, including the at least second and third antenna elements, is a linear section.

In some embodiments, the further antenna elements, such as the plurality of further antenna elements, are provided in different planes. Alternatively, at least some of the further antenna elements, such as the plurality of further antenna elements, are provided in the same plane. Alternatively, all of the further antenna elements, such as the plurality of further antenna elements, are provided in the same plane.

In some embodiments, the plurality of further antenna elements, such as the further antenna elements, including the at least second and third antenna elements, are connected in parallel. In some embodiments, radiation resistance and antenna efficiency may be increased by connecting the plurality of further antenna elements in parallel.

It has been found that radiation resistance and antenna efficiency may be increased by interconnecting a first antenna element with a plurality of further antenna elements, such as interconnecting a wrapped first antenna element with a plurality of wrapped further antenna elements, such as interconnecting a first antenna element with a plurality of further antenna elements wherein at least two of the antenna elements are wrapped into each other.

The embodiments of the present disclosure may enable better control of the fundamental tradeoff between antenna size, bandwidth and efficiency. Furthermore, antenna efficiency may be maintained while reducing the size of the antenna, thereby providing a smaller, such as a reduced, size antenna while keeping, such as retaining, such as sustaining, a satisfactory, such as acceptable, such as normal, such as standard, such as appropriate, level of antenna efficiency, thereby providing a small yet efficient antenna.

The terms "plurality of further antenna elements" and "further antenna elements" are used interchangeably though out this specification. Similarly, the term "antenna structure" is used interchangeably with the term "antenna". The use of one term instead of the other should not be considered as limiting.

A hearing instrument includes: a microphone for reception of sound and conversion of the received sound into a corresponding first audio signal; a signal processor for processing the first audio signal into a second audio signal compensating a hearing loss of a user of the hearing instrument; a speaker connected to an output of the signal processor for converting the second audio signal into an output sound signal; a wireless communication unit configured for wireless data communication; and an antenna for electromagnetic field emission and/or electromagnetic field reception, the antenna having a first antenna element and a plurality of additional antenna elements, the first antenna element having a first branch and a second branch, the first branch and the second branch being connected with the wireless communication unit, the first branch having a first connecting region and the second branch having a second connecting region; wherein one or each of the plurality of additional antenna elements interconnects the first connecting region of the first branch of the first antenna, and the second connecting region of the second branch of the first antenna.

Optionally, one or each of the plurality of additional antenna elements forms a resonant antenna structure with the first antenna element.

Optionally, the plurality of additional antenna elements includes at least a second antenna element and a third antenna element.

Optionally, the first branch has a first feed of the antenna at a first feed region, and the second branch has a second feed of the antenna at a second feed region, the first feed region and the second feed region being along the first branch and the second branch, respectively.

Optionally, the first connecting region is separated from the first feed region by a first distance, and wherein the second connecting region is separated from the second feed region by a second distance, each of the first and second distances being measured along the first antenna element.

Optionally, the first distance and/or the second distance is between one eighth and three eighths of a wavelength of an electromagnetic field associated with the antenna.

Optionally, a length of the first antenna element or one of the additional antenna elements corresponds to half of a wavelength of an electromagnetic field associated with the antenna.

Optionally, the hearing instrument has a first side and a second side, and wherein the plurality of additional antenna elements comprises a second antenna element and a third antenna element.

Optionally, each of the second and third antenna elements extends from the first side to the second side.

Optionally, the first connecting region is located closer to the first side than to the second side, and wherein the second connecting region is located closer to the second side than to the first side.

Optionally, a midpoint of the second antenna element is located at a first section of the second antenna element extending from the first side to the second side.

Optionally, the first branch extends along the first side and wherein the first connecting region is located closer to the first side than to the second side; and wherein the second branch extends along the second side and wherein the second connecting region is located closer to the second side than to the first side.

Optionally, the antenna has a configuration such that a current running through the antenna has a maximum amplitude in, or proximate to, a section of one of the additional antenna elements during electromagnetic field emission.

Optionally, the first branch and the second branch have a similar shape and/or form.

Optionally, the first antenna element and at least one of the plurality of additional antenna elements are wrapped with each other.

Optionally, the second antenna element has a first section, and a second section extending from the first connecting region; and wherein the first branch of the first antenna element and the second section of the second antenna element are arranged in a meandering form.

Optionally, the second antenna element has a first section, and a second section extending from the first connecting region; and wherein the first branch of the first antenna element and the second section of the second antenna element are arranged in a coiled form.

Optionally, the coiled form comprises a spiral form, a helix form, or a curled form.

Optionally, the additional antenna elements are located in different planes.

In the following the embodiments are described primarily with reference to a hearing instrument, such as a hearing aid. The hearing instrument may be a binaural hearing instrument. It is however envisaged that any embodiments or elements as described in connection with any one aspect may be used with any other aspects or embodiments, mutatis mutandis.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
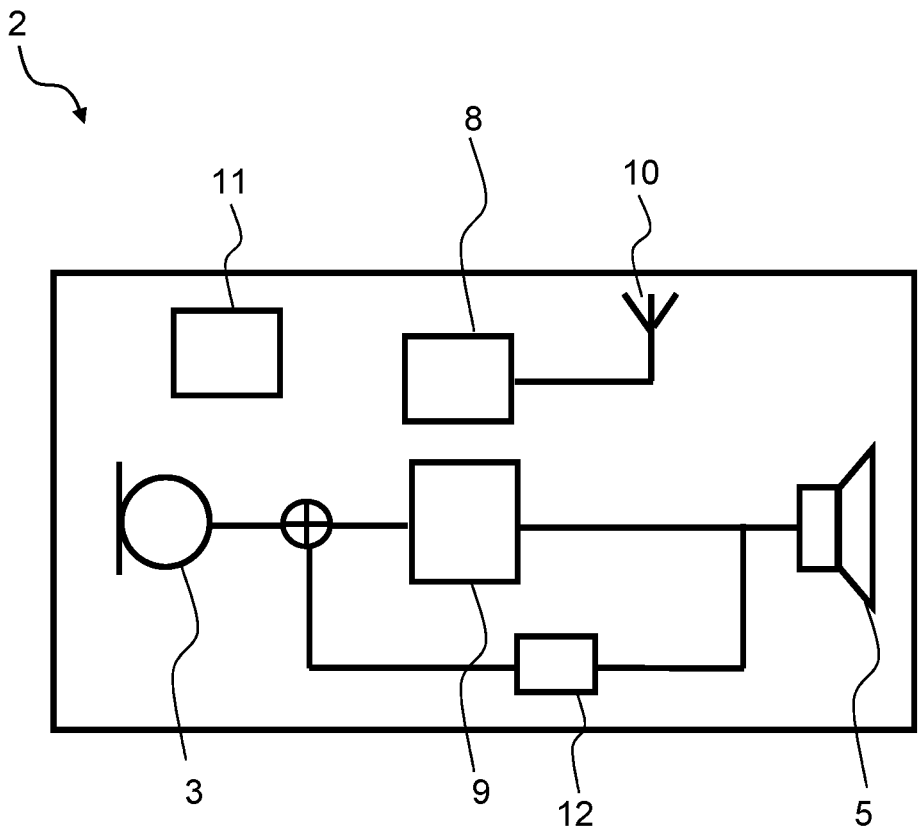
FIG. 1 shows a block-diagram of an exemplary hearing instrument according to the present disclosure, FIG. 2 schematically illustrates an exemplary antenna for a hearing instrument according to the present disclosure, FIGS. 3*a* and 3*b* schematically illustrate an exemplary antenna for a hearing instrument according to the present disclosure, FIG. 4 schematically illustrates an exemplary antenna for a hearing instrument according to the present disclosure, FIG. 5 schematically illustrates an exemplary antenna for a hearing instrument according to the present disclosure, FIGS. 6*a* and 6*b* schematically illustrate behind-the-ear hearing instruments with an exemplary antenna according to the present disclosure, FIGS. 7*a* and 7*b* schematically illustrate behind-the-ear hearing instruments with an exemplary antenna according to the present disclosure, FIG. 8 schematically illustrates a 2D representation of an antenna configured for an in-the-ear hearing instrument according to the present disclosure, FIG. 9 schematically illustrates a 3D representation of an antenna configured for an in-the-ear hearing instrument according to the present disclosure.

In some embodiments, the hearing instrument comprises at least one behind-the-ear module configured to be positioned behind the ear of a user when provided in its intended operational position. Traditionally, the behind-the-ear module comprises at least the signal processor, the wireless communication unit, and in some embodiments at least one antenna element. A hearing instrument battery is typically also provided in the behind the ear element.

The hearing instrument may be a behind-the-ear type hearing instrument, in which the behind-the-ear module comprises the hearing instrument components provided as an assembly and mounted in a housing being configured to be worn behind the ear of a user in the operational position. Typically, a sound tube extends from the hearing instrument housing to the ear canal of the user.

The hearing instrument may be a receiver-in-the-ear type hearing instrument, in which the receiver is positioned in the ear, such as in the ear canal, of a user during use, for example as part of an in-the-ear module, while other hearing instrument components, such as the processor, the wireless communication unit, the battery, etc. are provided as a behind-the-ear module. Typically, a wire/cable or a tube connects the in-the-ear module and the behind-the-ear module. It should be envisaged that the tube module comprising the tube or wire/cable, may comprise further hearing instrument components and connectors, and the wire/cable may be provided in a tube.

The hearing instrument may be an in-the-ear or completely-in-the-canal type hearing instrument in which the hearing instrument is provided in the ear of a user. Thus, the in-the-ear module comprises the hearing instrument components, including the processor, the wireless communication unit, the battery, the microphone and speaker, etc.

The in-the-ear module may have one or more parts extending into the ear canal. The in-the-ear module may thus be configured to be positioned in the ear and in the ear canal.

Any combination of the modules as well as any distribution of hearing instrument components between the modules as set out above may be envisaged. For example a hearing instrument having most of the hearing instrument components provided in an in-the-ear module may for example have a power source, such as a battery, provided in a behind the-ear-module and having only a power connection through the tube module. In some examples, such a behind-the-ear module may also comprise one or more antenna elements.

For example, in some embodiments, a behind-the-ear hearing instrument may be provided having a behind the ear module, an in-the-ear module and a connection between the two modules, such as a tube module. Typically, the hearing instrument components may be distributed between the modules. In many hearing instruments, the receiver is positioned in the in-the-ear module.

In some embodiments, the hearing instruments have an in-the-ear module, and no behind-the-ear module. For example, the hearing instrument may consist of an in-the-ear module, in which all the hearing instrument components are provided in the in-the-ear module. In some embodiments, the hearing instruments have an in-the-ear module, and an additional module interconnected to the in-the-ear module, the additional module may be configured to be provided in the outer ear, such as in the concha of the ear, in the helix of an ear, the additional module may be configured to be positioned anywhere at the ear at a position which is not behind the ear of the user. The additional module may comprise a microphone and/or other transducer components, a battery, etc.

Such and further types of hearing instruments are typically promoted under names such as ITE, in-the-ear, full shell, RIE, right-in-ear, half shell, ITC, in-the-canal, IIC invisible-in-the-canal, CIC completely-in-the-canal, MIH, microphone-in-the-helix, etc.

It will be appreciated that the speaker of a hearing instrument is also known in the art as a "receiver".

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Throughout, the same reference numerals are used for identical or corresponding parts.

A block-diagram of an exemplary hearing instrument 2 is shown in FIG. 1. The hearing instrument 2 comprises a microphone 3, for receiving incoming sound and converting it into an audio signal, i.e. a first audio signal. The first audio signal is provided to a signal processor 9 for processing the first audio signal into a second audio signal compensating a hearing loss of a user of the hearing instrument 2. A speaker 5 is connected to an output of the signal processor 9 for converting the second audio signal into an output sound signal, e.g. a signal modified to compensate for a user's hearing impairment.

Thus, the hearing instrument signal processor 9 comprises elements such as amplifiers, compressors and noise reduction systems etc. The hearing instrument may further have a filter function, such as compensation filter 12 for optimizing the output signal. The hearing instrument may furthermore have a wireless communication unit 8 for wireless data communication interconnected with an antenna 10 for emission and reception of an electromagnetic field. The wireless communication unit 8, such as a radio or a transceiver, connects to the hearing instrument signal processor 9 and the antenna 10, for communicating with external devices, with another hearing instrument, such as another hearing instrument, located at another ear, typically in a binaural hearing instrument system, etc. The hearing instrument 2 further comprises a power source 11, such as a battery.

The hearing instrument may comprise a part being configured to be provided behind the ear of a user, the hearing instrument may comprise a behind-the-ear module, the hearing instrument may be a behind-the-ear hearing instrument. Alternatively, the hearing instrument may comprise a part configured to be positioned in the ear of a user, the hearing instrument may comprise an in-the-ear module, the hearing instrument may be provided as an in-the-ear hearing instrument.

Figure 2:
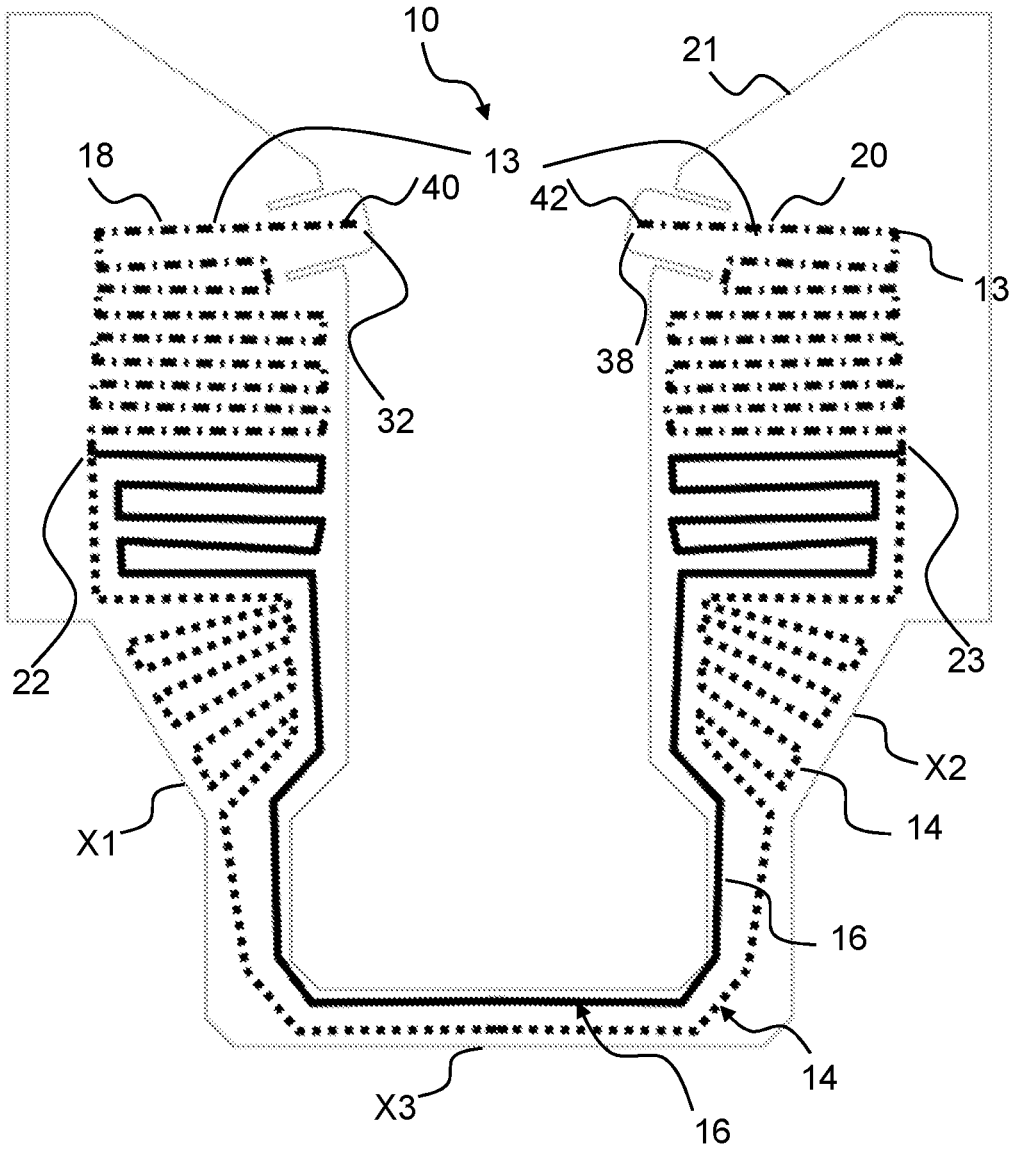

FIG. 2 shows an exemplary antenna 10 according to one embodiment of the present disclosure. The antenna 10 is illustrated as provided on a flexible substrate 21, such as a flexible plastic substrate. The antenna 10 is configured to be provided in a behind-the-ear hearing instrument (not shown), such as in a behind-the-ear module.

The antenna 10 comprises a first antenna element 13 (dashed-dotted line) and a plurality of further antenna elements 14, 16 (solid line and dotted line). Each of the plurality of further antenna elements 14, 16 forms a resonant antenna structure with the first antenna element 13. The plurality of further antenna elements 14, 16 includes at least second antenna element 14 and third antenna element 16. However, it is envisaged that the plurality of further antenna elements may comprise more than 2 antenna elements, such as 3, such as 4, such as 5, such as up to 10 further antenna elements.

The first antenna element 13 comprises a first branch 18 and a second branch 20. The first branch 18 and the second branch 20 are interconnected with the wireless communication unit (not shown). The first branch 18 comprises a first connecting region 22. The second branch 20 comprises a second connecting region 23. Each of the plurality of further antenna elements 14, 16 interconnects the first connecting region 22 and the second connecting region 23.

As illustrated in FIG. 2, the first branch 18 has a first feed at a first feed region 32 and the second branch 20 has a second feed at a second feed region 38. The first feed region 32 is provided along a first end 40 of the first branch 18. The second feed region 38 is provided along a first end 42 of the second branch 20. The first feed and the second feed of the antenna 10 are connected to the wireless communication unit (not shown). One feed of the antenna may be connected to a ground potential, such as to a ground potential of the wireless communication unit, and the other feed of the antenna may be connected to the wireless communication unit, such as to a transceiver or a radio in the wireless communication unit.

The first antenna element 13, the second antenna element 14 and the third antenna element 16 are arranged in a meandering shape and/or form, and it is seen that the meandering antenna pattern allows for a compact antenna structure.

The first branch 18 of the first antenna element 13 is configured to be arranged at a first partition X1 of the flexible substrate 21, and the second branch 20 of the first antenna element 20 is configured to be arranged at a second partition X2 of the flexible substrate 21. A bridge part X3 of the flexible substrate is configured to interconnect the first partition X1 and the second partition X2 of the flexible substrate. The flexible substrate is configured be folded around a hearing instrument, such as around a behind-the-ear hearing instrument or behind-the-ear module, for example with the bridge part X3 arranged on a top side of the behind-the-ear hearing instrument or module and the first partition X1 and the second partition X2 of the flexible substrate along first and second sides, such that partitions X1 and X2 are arranged on opposite sides of the behind-the-ear hearing instrument or the behind-the-ear module.

Figure 3A:
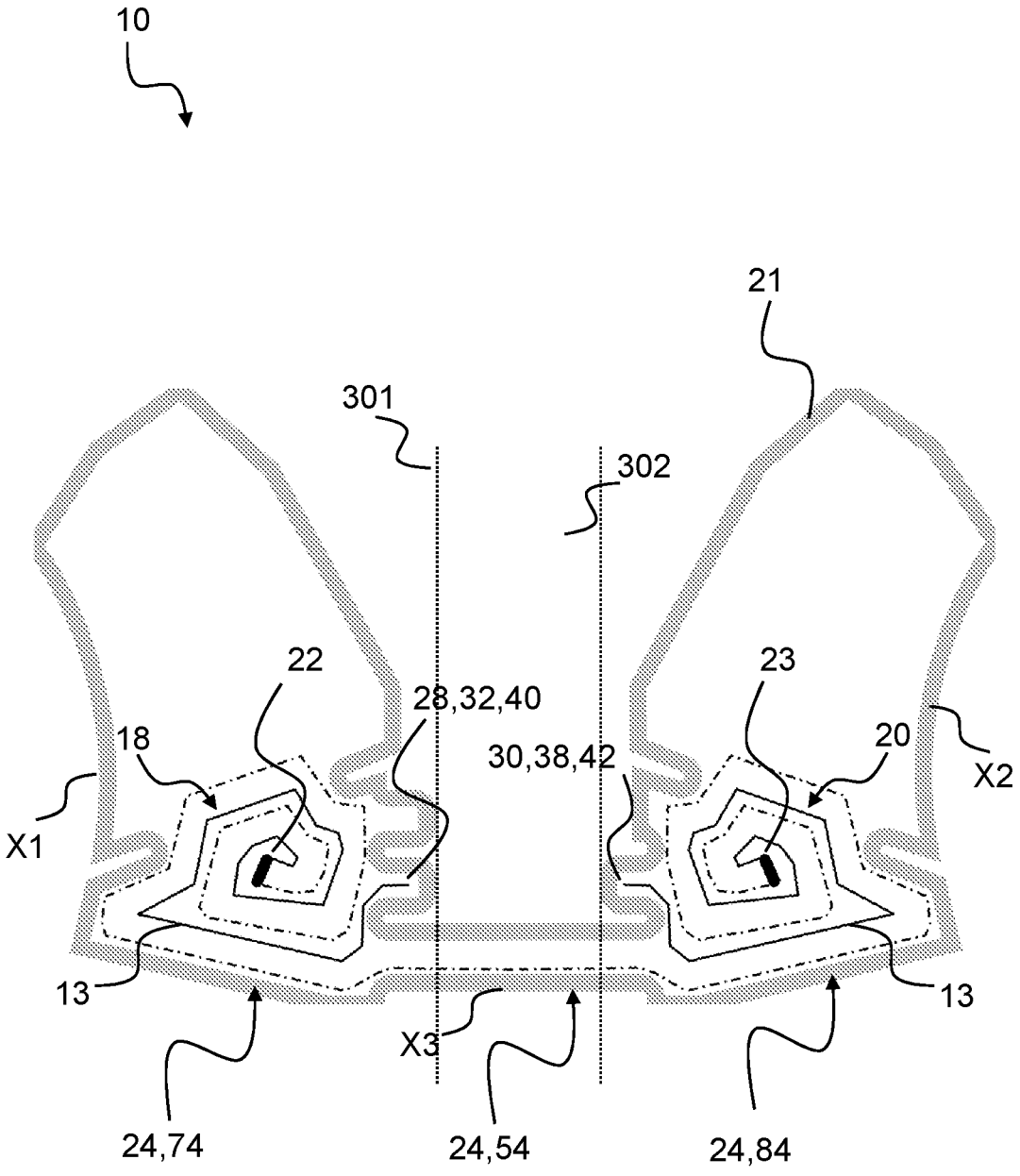

FIG. 3*a* shows an exemplary antenna 10 according to another embodiment of the present disclosure. The antenna 10 is illustrated as provided on a flexible substrate 21 and is configured to be provided at a behind-the-ear hearing instrument (not shown), such as at a behind-the-ear module.

The antenna 10 comprises a first antenna element 13 (solid line) and a second antenna element 24 (dash-dotted line). The first antenna element 13 is interconnected with the second antenna element 24. The second antenna element 24 is configured to form a resonant antenna structure with the first antenna element 13.

The first antenna element 13 comprises a first branch 18 and a second branch 20. The first branch 18 and the second branch 20 are interconnected with the wireless communication unit (not shown). The first branch 18 comprises a first connecting region 22. The second branch 20 comprises a second connecting region 23. The second antenna element 24 interconnects the first connecting region 22 and the second connecting region 23.

As illustrated in FIG. 3*a*, the first branch 18 has a first feed of the antenna 10 at a first feed region 32 and the second branch 20 has a second feed of the antenna 10 at a second feed region 38. The first feed region 32 is provided along a first end 40 of the first branch 18. The second feed region 38 is provided along a first end 42 of the second branch 20. The first feed of the antenna 10 and the second feed of the antenna 10 are connected to the wireless communication unit (not shown).) One feed of the antenna may be connected to a ground potential, such as to a ground potential of the wireless communication unit, and the other feed of the antenna may be connected to the wireless communication unit, such as to a transceiver or a radio in the wireless communication unit.

A first axis 301 and a second axis 302 divide the second antenna element 24 into a first section 54, a second section 74 and a third section 84.

The flexible substrate 21 is configured to be folded around at least parts of a hearing instrument, such as around at least parts of a behind-the-ear hearing instrument, or a behind-the-ear module. In some embodiments, the first axis 301 and the second axis 302 may illustrate edge parts of the hearing instrument or module, such that for example the second section 74 is extending along a first side of the hearing instrument, while the third section 84 is extending along another side of the hearing instrument. The first side may be opposite the second side. The first side may be a first longitudinal side and the second side may be a second longitudinal side of the hearing instrument. The first section 54 may interconnect the second section 74 and the third section 84, and may for example be configured to be arranged at a top side of the hearing instrument or module.

The second section 74 of the second antenna element 24 extends from the first connecting region 22. The third section 84 of the second antenna element 24 extends from the second connecting region 23. The first section 54 is a linear section, such as substantially a linear section. The first section 54 connects the second section 74 with the third section 84.

The first antenna element 13 and the second antenna element 24 are wrapped into each other, such that the first branch 18 of the first antenna element 13 and the second section 74 of the second antenna element 24 are wrapped into each other and such that the second branch 20 of the first antenna element 13 and the third section 84 of the second antenna element 24 are wrapped into each other.

The first branch 18 of the first antenna element 13 and the second section 74 of the second antenna element 24 are arranged in a meandering shape and/form, and the second branch 20 of the first antenna element 13 and the third section of the second antenna element 24 are arranged in a meandering shape and/or form. The first branch 18 of the first antenna element 13 and the second section 74 of the second antenna element 24 are arranged in a coiled shape and/or form. The second branch 20 of the first antenna element 13 and the third section 84 of the second antenna element 24 are arranged in a coiled and/or form.

As illustrated in FIG. 3*a*, the first branch 18 of the first antenna element 13 and the second section 74 of the second antenna element 24 are wrapped into each other providing a shape and/or form that is similar to and/or mirrors the shape and/or form of the second branch 20 of the first antenna element 13 and the third section 84 of the second antenna element 24 wrapped into each other. Alternatively, the shape and/or form of the first branch 18 of the first antenna element 13 and the second section 74 of the second antenna element 24 wrapped into each other may be different from the shape and/or form of the second branch 20 of the first antenna element 13 and the third section 84 of the second antenna element 24 wrapped into each other. It is seen that the first branch 18 of the first antenna element 13 and the second section 74 of the second antenna element 24 are wrapped into each other so that the first branch 18 of the first antenna element 13 and the second section 74 of the second antenna element 24 follows a same or similar pattern. The first branch 18 and the second section 74 are co-aligned, such that current vectors of any current flowing through the antenna elements will be co-aligned. The distance between the first branch 18 and the second section 74 is seen to be of a same or similar size along a significant part of the wrapped sections/elements. The distance between the first branch 18 and the second section 74 may be consistent along a significant part of the wrapped sections/elements, such as along 80% of the wrapped sections/elements. The same applies mutatis mutandis for the second branch 18 of the first antenna element 13 and the second section 74 of the second 24 antenna element.

As illustrated, the first branch 18 of the first antenna element 13 and the second section 74 of the second 24 antenna element are arranged in a same coiled shape and/or form, such that the first branch 18 of the first antenna element 13 and the second section 74 of the second antenna element 24 trace a same path. The second branch 20 of the first antenna element 13 and the third section 84 of the second antenna element 24 are arranged in a same coiled shape and/or form, such that the second branch 20 of the first antenna element 13 and the third section 84 of the second antenna element 24 trace a same path. The first branch 18 of the first antenna element 13 and the second section 74 of the second antenna element 24 are provided with consistent spacing along at least a part of the path. The second branch 20 of the first antenna element 13 and the third section 84 of the second antenna element 24 are provided with consistent spacing along at least a part of the path.

Figure 3B:
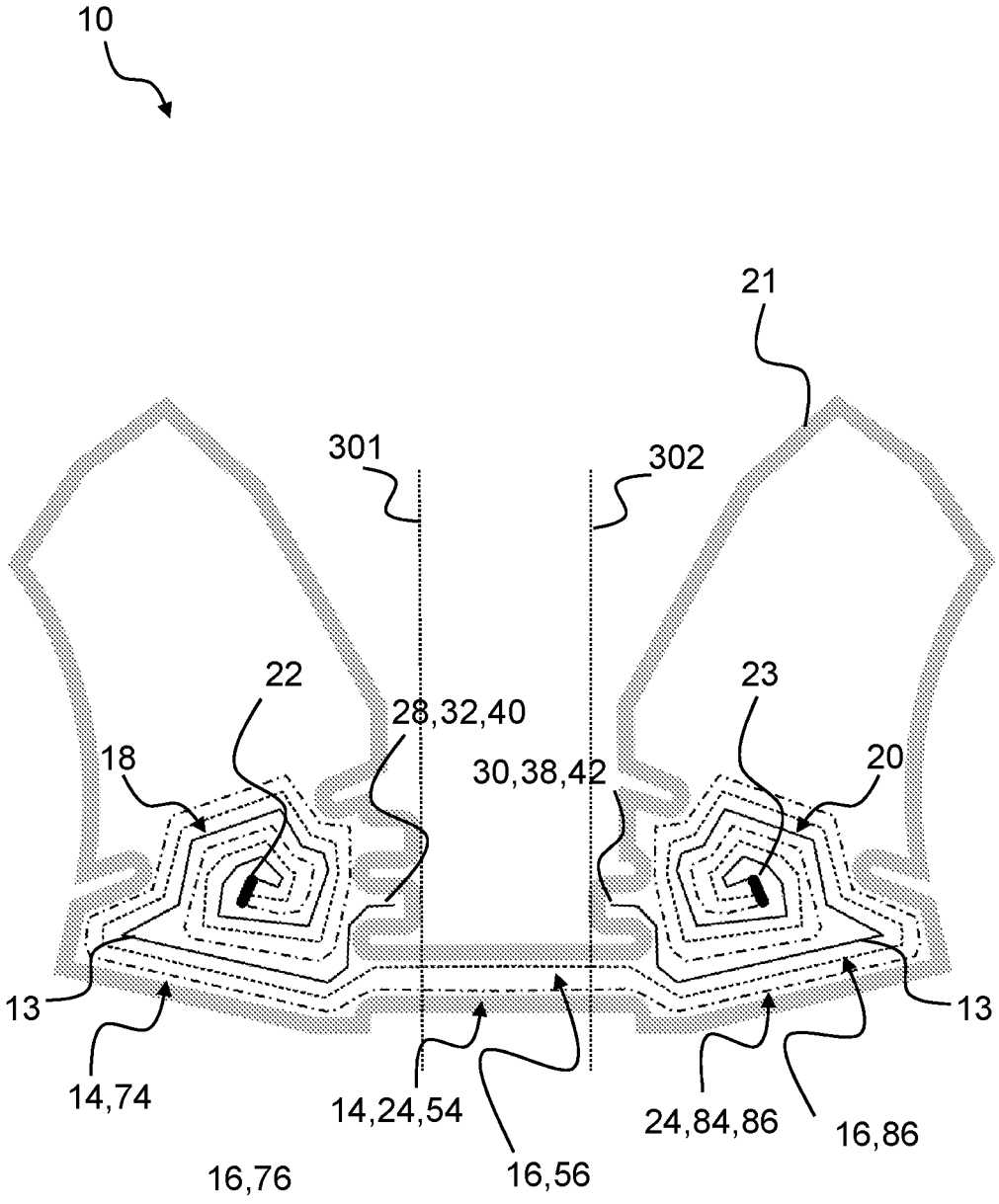

FIG. 3*b* shows an exemplary antenna 10 according to another embodiment of the present disclosure. The antenna 10 is illustrated as provided on a flexible substrate 21, such as a flexible plastic substrate, (gray line) and is configured to be provided at a behind-the-ear hearing instrument (not shown), such as at a behind-the-ear module.

The antenna 10 comprises a first antenna element 13 (solid line) and a plurality of further antenna elements 24, 26. The plurality of further antenna elements comprises a second antenna element 24 (dash-dotted line) and a third antenna element 26 (dotted line). The first antenna element 13 is interconnected with the plurality of further antenna elements 24, 26, including the second antenna element 24 and the third antenna element 26. Each of the plurality of further antenna elements 24, 26, including the second antenna element 24 and the third antenna element 26, forms a resonant antenna structure with the first antenna element 13.

The first antenna element 13 comprises a first branch 18 and a second branch 20. The first branch 18 and the second branch 20 are interconnected with the wireless communication unit (not shown). The first branch 18 comprises a first connecting region 22. The second branch 20 comprises a second connecting region 23. The plurality of further antenna elements 24, 26, including the second antenna element 24 and the third antenna element 26, interconnects the first connecting region 22 and the second connecting region 23.

As illustrated in FIG. 3*b*, the first branch 18 has a first feed 28 of the antenna structure at a first feed region 32 and the second branch 20 has a second feed 30 of the antenna structure at a second feed region 38. The first feed region 32 is provided along a first end 40 of the first branch. The second feed region 38 is provided along a first end 42 of the second branch. The first feed 28 of the antenna structure and the second feed 30 of the antenna structure are connected to the wireless communication unit (not shown). One feed of the antenna may be connected to a ground potential, such as to a ground potential of the wireless communication unit, and the other feed of the antenna may be connected to the wireless communication unit, such as to a transceiver or a radio in the wireless communication unit.

A first axis 301 and a second axis 302 divide the plurality of further antenna elements 2426, including the second antenna element 24 and the third antenna element 26 into first sections 54, 56, second sections 74, 76 and third sections 84, 86. The second sections 74, 76 of the second antenna element 24 and the third antenna element 26 extend from the first connecting region 22. The third sections 84, 86 of the second antenna element 24 and the third antenna element 26 extend from the second connecting region 23. The first sections 54, 56 are a linear sections, such as substantially linear sections. The first sections 54, 56 connects the second sections 74, 76 with the third section 84, 86.

The first antenna element 13, the second antenna element 24 and the third antenna element 26 are wrapped into each other, such that the first branch 18 of the first antenna element 13 and the second sections 74, 76 of the second and third antenna elements 24, 26 are wrapped into each other and such that the second branch 20 of the first antenna element 13, the third sections 84, 86 of the second and third antenna elements 24, 26 are wrapped into each other.

The first branch 18 of the first antenna element 13, the second section 74 of the second antenna element 24 and the second section 76 of the third antenna element 26 are arranged in a meandering shape and/form. The second branch 20 of the first antenna element 13, the second section 74 of the second antenna element 24 and the second section 76 of the third antenna element 26 are arranged in a meandering shape and/or form. The first branch 18 of the first antenna element 13, the second section 74 of the second antenna element 24 and the second section 76 of the third antenna element 26 are arranged in a spiral shape and/or form. The first branch 18 of the first antenna element 13, the second section 74 of the second antenna element 24 and the second section 76 of the third antenna element 26 are arranged in a spiral and/or form. It is seen that the first branch 18 of the first antenna element 13, the second section 74 of the second antenna element 24 and the second section 76 of the third antenna element 26 are wrapped into each other so that the first branch 18 of the first antenna element 13, the second section 74 of the second antenna element 24 and the second section 76 of the third antenna element 26 follows a same or similar pattern. The first branch 18, the second section 74 and the second section 76 are co-aligned, such that current vectors of any current flowing through the antenna elements will be co-aligned. The distance between the first branch 18, the second section 74 and the second section 76 is seen to be of a same or similar size along a significant part of the wrapped sections/elements, such as along 80% of the wrapped sections/elements. The distance between the first branch 18, the second section 74 and the second section 76 may be consistent along a significant part of the wrapped sections/elements, such as along 80% of the wrapped sections/elements. The same applies mutatis mutandis for the second branch 20 of the first antenna element 13, the third section 84 of the second antenna element 24 and the third section 86 of the third antenna element 26.

FIG. 3*b* illustrates that the shape and/or form of the first branch 18 of the first antenna element 13 and the second sections 74, 76 of the second and third antenna elements 24, 26 wrapped into each other mirrors or is similar to the shape and/or form of the second branch 20 of the first antenna element 13 and the third sections 84, 86 of the second and third antenna elements 24, 26 wrapped into each other. Alternatively, the shape and/or form of the first branch 18 of the first antenna element 13 and the second sections 74, 76 of the second and third antenna elements 24, 26 folded into each other may be different from the shape and/or form of the second branch 20 of the first antenna element 13 and the third sections 84, 86 of the second and third antenna elements 24, 26 wrapped into each other.

As illustrated, the first branch 18 of the first antenna element 13, the second section 74 of the second 24 antenna element and the second section 76 of the third antenna element 26 are arranged in a same shape and/or form, such that the first branch 18 of the first antenna element 13 and the second sections 74, 76 of the second and third antenna elements 24, 26 trace a same path. The second branch 20 of the first antenna element 13, the third section 84 of the second antenna element 24 and the third section 86 of the third antenna element 26 are arranged in a same shape and/or form, such that the second branch 20 of the first antenna element 13 and the third sections 84, 86 of the second and third antenna elements 24, 26 trace a same path. The first branch 18 of the first antenna element 13 and the second sections 74, 76 of the second and third antenna elements 24, 26 are provided with consistent spacing along at least a part of the path. The second branch 20 of the first antenna element 13 and the third sections 84, 86 of the second and third antenna elements 24, 26 are provided with consistent spacing along at least a part of the path.

Figure 4:
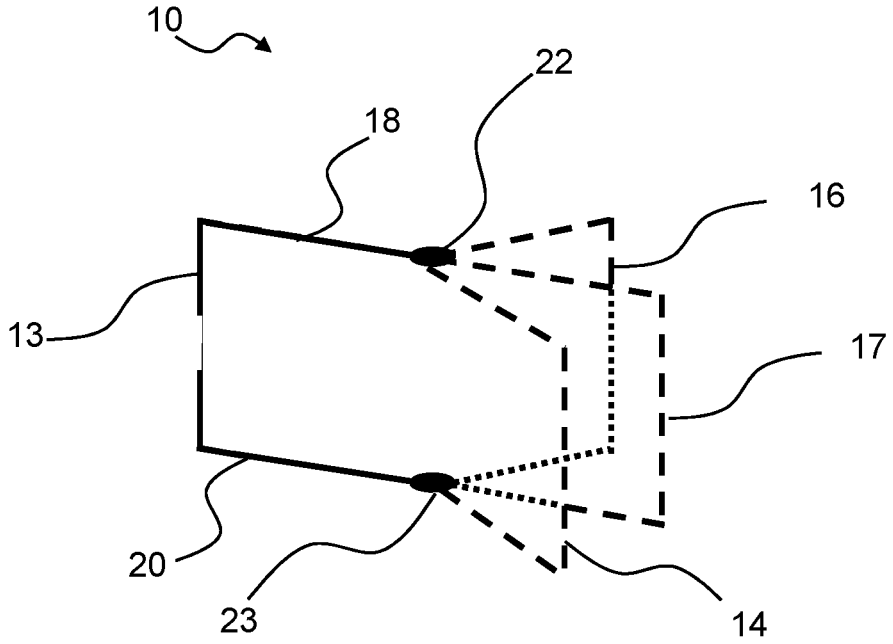

FIG. 4 schematically shows a further exemplary antenna 10 according to the present disclosure. The antenna 10 comprises a first antenna element 13 and a plurality of further antenna elements 14, 16, 17. The plurality of further antenna elements comprises a second antenna element 14, a third antenna element 16 and a fourth antenna element 17. The first antenna element 13 comprises a first branch 18 and a second branch 20 that are interconnected with a wireless communication unit (not shown). The first branch 18 comprises a first connecting region 22. The second branch 20 comprises a second connecting region 23. The plurality of further antenna elements 14, 16, 17 including the second antenna element 14, the third antenna element 16 and the fourth antenna element 17 interconnects the first connecting region 22 and the second connecting region 23. The first antenna element 13 is interconnected with the plurality of further antenna elements 14, 16, 17, including the second antenna element 14, the third antenna element 16 and the fourth antenna element 17. Each of the plurality of further antenna elements 14, 16, 17 including the second, third and fourth antenna elements 14, 16, 17, forms a resonant antenna structure with the first antenna element 13.

Each of the further antenna elements, including the second antenna element 14, the third antenna element 16 and the fourth antenna element 17, have approximately a same length.

As illustrated in FIG. 4, the plurality of further antenna elements 14, 16, 17, including the second antenna element 14, the third antenna element 16 and the fourth antenna element 17, are provided in different planes. The plurality of further antenna elements 14, 16, 17, including the second antenna element 14, the third antenna element 16 and the fourth antenna element 17, are connected in parallel.

It should be emphasized that the connecting regions 22, 23 may have a shape and an extent configured according to the antenna configuration. The connecting regions may be point like areas, they may be elongated areas, the may have a length so that each of the plurality of further antenna elements may be connected in the connecting regions, etc.

Figure 5:
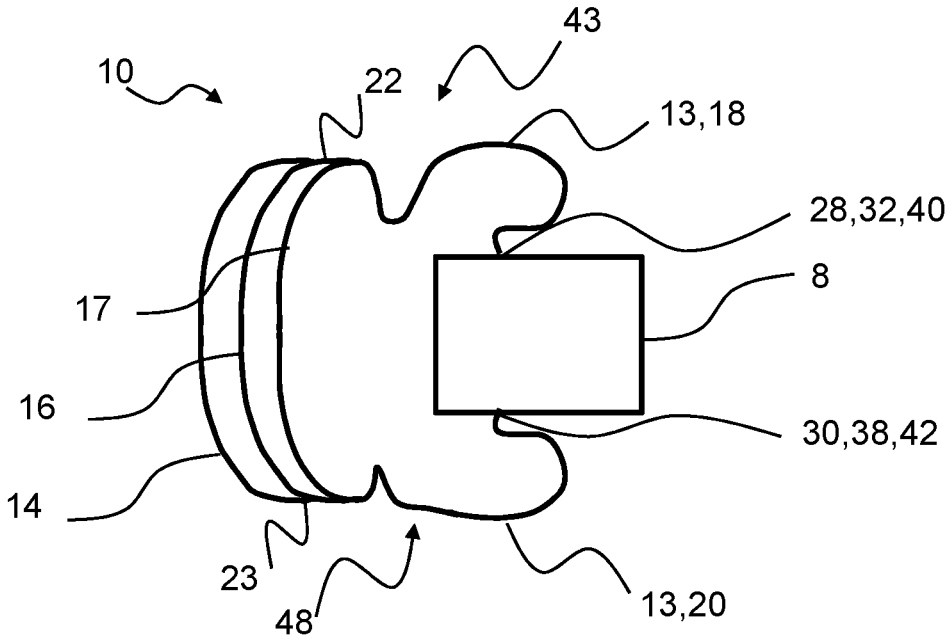

FIG. 5 schematically shows a further example of an exemplary antenna 10 according to the present disclosure. The antenna 10 comprises a first antenna element 13 and a plurality of further antenna elements 14, 16, 17. The plurality of further antenna elements comprises a second antenna element 14, a third antenna element 16 and a fourth antenna element 17. The first antenna element 13 comprises a first branch 18 and a second branch 20 being interconnected with a wireless communication unit 8. The first branch 18 comprises a first connecting region 22. The second branch 20 comprises a second connecting region 23. The plurality of further antenna elements 14, 16, 17, including the second antenna element 14, the third antenna element 16 and the fourth antenna element 17, interconnects the first connecting region 22 and the second connecting region 23. The first antenna element 13 is interconnected with the plurality of further antenna elements 14, 16, 17, including the second antenna element 14, the third antenna element 16 and the fourth antenna elements 17. Each of the plurality of further antenna elements 14, 16, 17 including the second, third and fourth antenna elements 14, 16, 17, may form a resonant antenna structure with the first antenna element 13.

The first branch 18 of the first antenna element 13 is arranged in a meandering form and/or shape. The second branch 20 of the first antenna element 13 is arranged in a meandering form and/or shape. As illustrated in FIG. 5, the first branch 18 of the first antenna element 13 and the second branch 20 of the first antenna element 13 are formed in different forms and/or shapes. Alternatively, the first branch 18 and the second branch 20 may have similar forms and/or shapes. The form and/or shape or the first branch 18 and/or of the second branch 20 can be any shape and/or form. In some embodiments, the first branch 18 and the second branch 20 are of the same or similar lengths. In some embodiments, the first branch 18 and the second branch 20 are of different lengths.

The first branch 18 has a first feed 28 of at a first feed region 32 and the second branch 20 has a second feed 30 at a second feed region 38. The first feed region 32 is provided along a first end 40 of the first branch 18. The second feed region 38 is provided along a first end 42 of the second branch 20. The first feed 28 of the antenna 13 and the second feed 30 of the antenna 13 are connected to the wireless communication unit 8. One feed of the antenna may be connected to a ground potential, such as to a ground potential of the wireless communication unit, and the other feed of the antenna may be connected to the wireless communication unit, such as to a transceiver or a radio in the wireless communication unit.

Each of the further antenna elements, including the second antenna element 24, the third antenna element 26 and the fourth antenna element 27, have approximately a same length.

The plurality of further antenna elements, including the second antenna element 24, the third antenna element 26 and the fourth antenna element 27, are connected in parallel.

The first connecting region 22 is separated from the first feed region 32 by a first distance 43, the first distance 43 being measured along the first antenna element 13, such as along the first branch 18 of the first antenna element 13. The second connecting region 23 is separated from the second feed region 38 by a second distance 48, the second distance 48 being measured along the first antenna element 13, such as along the second branch 20 of the first antenna element 13. The antenna 10 is configured for emission and reception of an electromagnetic field having a transceiving wavelength ($\lambda$). The first distance 43 and/or the second distance 48 is between one eighth (1/8) and three eighths (3/8) of the transceiving wavelength ($\lambda$). As illustrated, the first distance 43 is different than the second distance 48. Alternatively, the first distance 43 may be equal to, such as the same as, the second distance 48.

Each of the further antenna elements 14, 16, 17 have approximately a same length. The length of each antenna element, such as the length of the first antenna element 13 and the lengths of the plurality of further antenna elements 14, 16, 17, corresponds to half a length of the transceiving wavelength (λ).

Figure 6A:
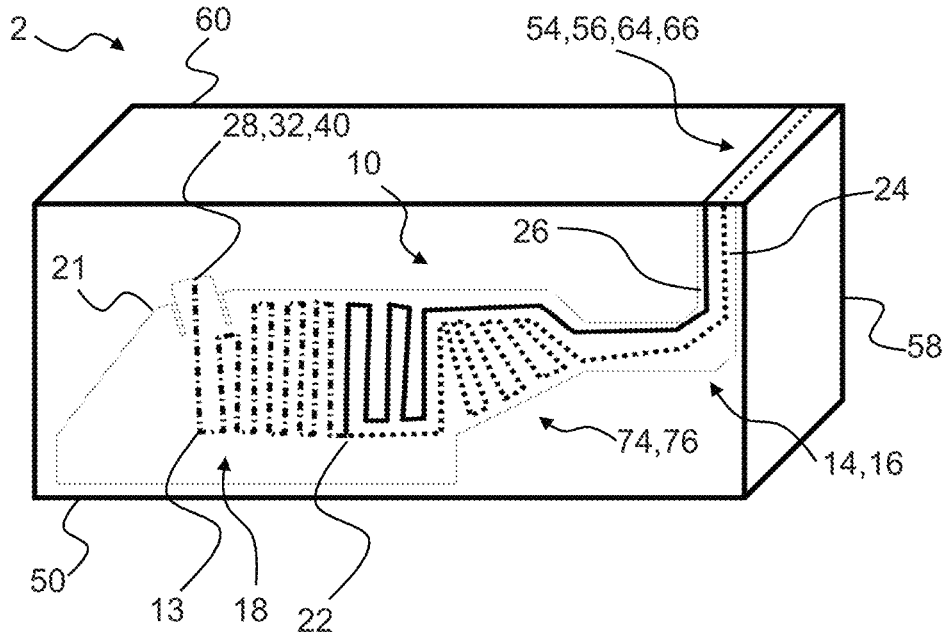
Figure 6B:
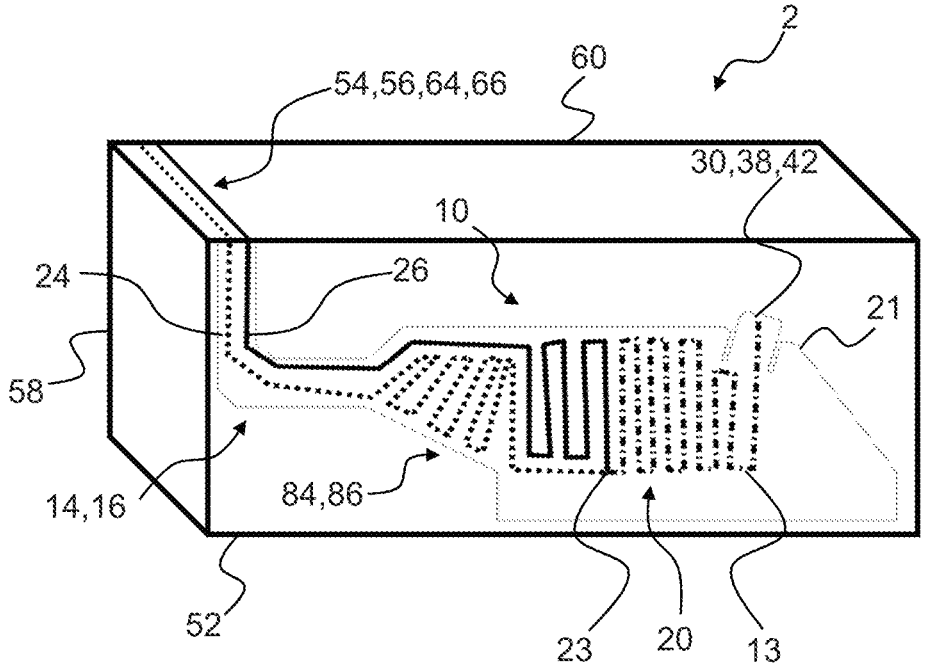

FIGS. 6*a* and 6*b* show an exemplary hearing instrument 2 having an antenna 10 according to one embodiment of the present disclosure. The antenna 10 is illustrated as provided on a flexible plastic substrate 21 (gray line). The flexible plastic substrate 21 comprising the antenna 10 is illustrated as wrapped around the hearing instrument 2, such as around a behind-the-ear hearing instrument.

The hearing instrument 2 has a first side 50 and a second side 52. Additionally, the hearing instrument 2 has a third side 58. In FIGS. 6*a* and 6*b*, the hearing instrument 2 is presented as viewed from two different angles. FIG. 6*a* shows the first side 50 and the third side 58, while FIG. 6*b* shows the second side 52 and the third side 58. Additionally, the hearing instrument has a top side 60. The top side 60 is the side of the hearing instrument 2 that is approximately, such as substantially, pointing upwards and/or backwards, when the hearing instrument 2 is used by a user that is sitting or standing upright.

The antenna 10 comprises a first antenna element 13 (dashed-dotted line) and a plurality of further antenna elements 14, 16 (solid line and dotted line). Each of the plurality of further antenna elements 14, 16 forms a resonant antenna structure with the first antenna element 13. The plurality of further antenna elements 14, 16 includes a second antenna element 14 and a third antenna element 16. Alternatively, the plurality of further antenna elements 14, 16 may include additional antenna elements, such as a fourth antenna element, such as a fifth antenna element.

Each of the plurality of further antenna elements 14, 16, including the second antenna element 14 and third antenna element 16, extends from the first side 50 to the second side 52 of the hearing instrument 2. Thus, the plurality of further antenna elements 14, 16 extends over the top side 60 of the hearing instrument 2. The first side 50 is opposite to the second side 52.

The first antenna element 13 comprises a first branch 18 and a second branch 20. The first branch 18 comprises a first connecting region 22. The second branch 20 comprises a second connecting region 23. The first branch 18 extends along the first side 50. The first connecting region 22 is provided at the first side 50. The second branch 20 extends along the second side 52. The second connecting region 23 is provided at the second side 52. The first branch 18 and the second branch 20 are interconnected with the wireless communication unit (not shown). Each of the plurality of further antenna elements 14, 16 interconnects the first connecting region 22 and the second connecting region 23.

As illustrated in FIG. 6, the first branch 18 has a first feed 28 of the antenna structure at a first feed region 32 and the second branch 20 has a second feed 30 of the antenna structure at a second feed region 38. The first feed region 32 is provided along a first end 40 of the first branch 18. The second feed region 38 is provided along a first end 42 of the second branch 20. The first feed 28 of the antenna structure and the second feed 30 of the antenna structure are connected to the wireless communication unit (not shown).

Each of the plurality of further antenna elements 14, 16, including the second antenna element 14 and the third antenna element 16, extends from the first side 50 to the second side 52. Thus, at least a first section 54, 56 of each of the further antenna elements 14, 16, including the second antenna element 14 and the third antenna element 16, extends from the first side 50 to the second side 52 of the hearing instrument 2. The first sections 54, 56 extend along the top side 60. The first sections 54, 56 of the further antenna elements 14, 16 are a linear sections. A midpoint 64, 66 of each of the further antenna elements 14, 16, including the second antenna element 24 and the third antenna element 26, are provided at the top side 60, thus are provided at the first section 54, 56 of each of the further antenna elements 14, 16 extending from the first side 50 to the second side 52. The midpoints 64, 66 of the further antenna elements 14, 16, including the second antenna element 24 and third antenna element 26, are the position from which the distance along each of the further antenna elements 14, 16, and the first connecting region 22 and the second connecting region 23, respectively, is the same, such as approximately or substantially the same. The midpoints may e.g. be at approximately one quarter of a wavelength from each connecting region.

The antenna 10 is constructed such that a current running through the antenna 10 has a maximum amplitude in or proximate to the top side. Thus, the antenna 10 is constructed such that a current running through the antenna 10 has a maximum amplitude in or proximate to the first section 54, 56 of each of the further antenna elements 14, 16, including the second antenna element 14 and the third antenna element 16, extending from the first side 50 to the second side 52 of the hearing instrument 2 during emission of the electromagnetic field.

The first branch 18 extending along the first side 50 and the second branch 20 extending along the second side 52 have a similar shape and/or form, such as a similar meandering shape and/or form. Alternatively, the first branch 18 extending along the first side 50 and the second branch 20 extending along the second side 52 may have different shapes and/or forms.

Each of the further antenna elements 14, 16, including the second antenna element 14 and the third antenna element 16, have second sections 74, 76 extending from the first connecting region 22 along the first side 50 of the hearing instrument 2. Each of the further antenna elements 14, 16, including the second antenna element 14 and the third antenna element 16, have third sections 84, 86 extending from the second connecting region 23 along the second side 52 of the hearing instrument 2.

The first branch 18 of the first antenna element 13 and the second sections 74, 76 of the further antenna elements 14, 16 are arranged in a meandering form and/or shape. The second branch 20 of the first antenna element 13 and the third sections 84, 86 of the further antenna elements 14, 16 are arranged in a meandering form and/or shape.

The first branch 18 of the first antenna element 13 and the second sections 74, 76 of the further antenna elements 14, 16 are provided with consistent spacing along at least a part of the path. The second branch 20 of the first antenna element 13 and the third sections 84, 86 of the further antenna elements 14, 16 are provided with consistent spacing along at least a part of the path.

Figure 7A:
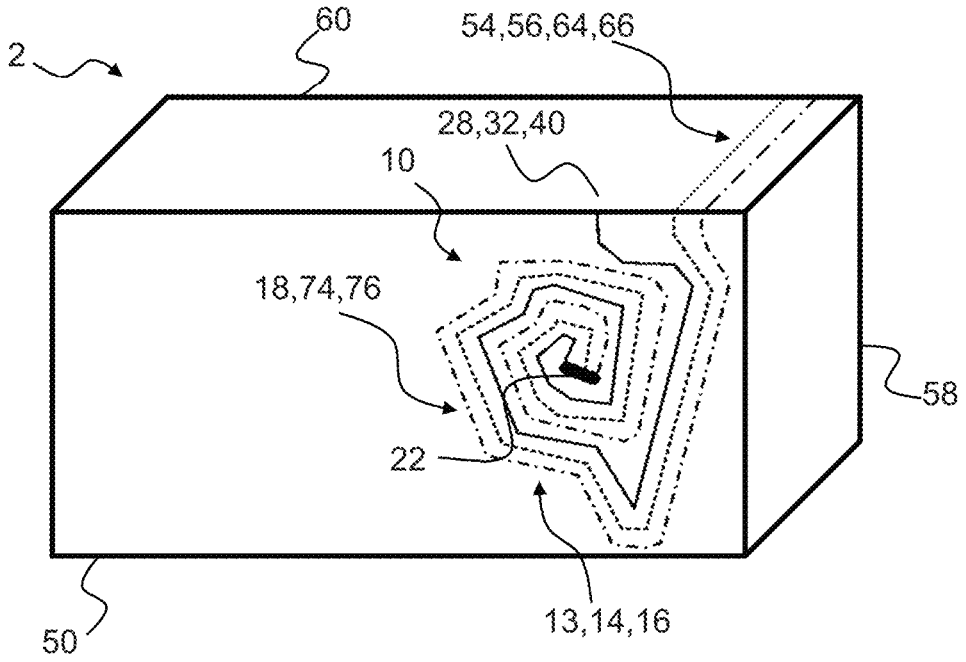
Figure 7B:
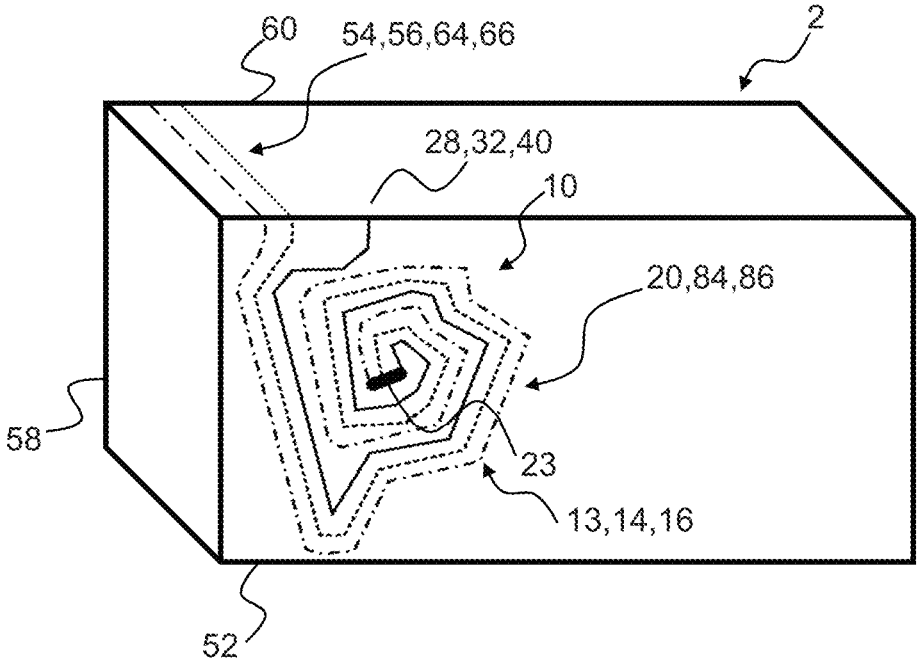

FIGS. 7*a* and 7*b* shows an exemplary hearing instrument 2 having an antenna 10 according to another embodiment of the present disclosure. The antenna 10 is illustrated as wrapped or folded around the hearing instrument 2, such as a behind-the-ear hearing instrument.

The hearing instrument 2 has a first side 50 and a second side 52. Additionally, the hearing instrument 2 has a third side 58. In FIGS. 7*a* and 7*b*, the hearing instrument 2 is presented as viewed from two different angles. FIG. 7*a* shows the first side 50 and the third side 58, while FIG. 7*b* shows the second side 52 and the third side 58. Additionally, the hearing instrument has a top side 60. The top side 60 is the side of the hearing instrument 2 that is approximately, such as substantially, pointing upwards when the hearing instrument 2 is used by a user that is sitting or standing upright.

The antenna 10 comprises a first antenna element 13 (solid line) and a plurality of further antenna elements 14, 16 (dashed-dotted line and dotted line). Each of the plurality of further antenna elements 14, 16 forms a resonant antenna structure with the first antenna element 13. The plurality of further antenna elements 14, 16 includes a second antenna element 14 and a third antenna element 16. Alternatively, the plurality of further antenna elements 14, 16 may include additional antenna elements, such as a fourth antenna element, such as a fifth antenna element.

Each of the plurality of further antenna elements 14, 16, including the second antenna element 14 and third antenna element 16, extends from the first side 50 to the second side 52 of the hearing instrument 2. Thus, the plurality of further antenna elements 14, 16 extends over the top side 60 of the hearing instrument 2. The first side 50 is opposite to the second side 52.

The first antenna element 13 comprises a first branch 18 and a second branch 20. The first branch 18 comprises a first connecting region 22. The second branch 20 comprises a second connecting region 23. The first branch 18 extends along the first side 50. The first connecting region 22 is provided at the first side 50. The second branch 20 extends along the second side 52. The second connecting region 23 is provided at the second side 52. The first branch 18 and the second branch 20 are interconnected with the wireless communication unit (not shown). Each of the plurality of further antenna elements 14, 16 interconnects the first connecting region 22 and the second connecting region 23.

As illustrated in FIG. 7, the first branch 18 has a first feed 28 of the antenna structure at a first feed region 32 and the second branch 20 has a second feed 30 of the antenna structure at a second feed region 38. The first feed region 32 is provided along a first end 40 of the first branch 18. The second feed region 38 is provided along a first end 42 of the second branch 20. The first feed 28 of the antenna structure and the second feed 30 of the antenna structure are connected to the wireless communication unit (not shown). One feed of the antenna may be connected to a ground potential, such as to a ground potential of the wireless communication unit, and the other feed of the antenna may be connected to the wireless communication unit, such as to a transceiver or a radio in the wireless communication unit.

Each of the plurality of further antenna elements 14, 16, including the second antenna element 14 and the third antenna element 16, extends from the first side 50 to the second side 52. Thus, at least a first section 54, 56 of each of the further antenna elements 14, 16, including the second antenna element 14 and the third antenna element 16, extends from the first side 50 to the second side 52 of the hearing instrument 2. The first sections 54, 56 extend along the top side 60. The first section 54, 56 of the further antenna elements 14, 16 is a linear section. A midpoint 64, 66 of each of the further antenna elements 14, 16, including the second antenna element 14 and the third antenna element 16, are provided at the top side 60, thus are provided at the first section 54, 56 of the antenna element extending from the first side 50 to the second side 52. The midpoints 64, 66 of the further antenna elements 14, 16, including the second antenna element 14 and third antenna element 16, are the position from which the distance along each of the further antenna elements 14, 16, including the second antenna element 14 and the third antenna element 16, and the first connecting region 22 and the second connecting region 23, respectively, is approximately or substantially the same. The midpoints may e.g. be at approximately one quarter of a wavelength from each connecting region.

The antenna 10 is constructed such that a current running through the antenna 10 has a maximum amplitude in or proximate to the top side 60. Thus, the antenna 10 is constructed such that a current running through the antenna 10 has a maximum amplitude in or proximate to the first section 54, 56 of each of the further antenna elements 14, 16, including the second antenna element 14 and the third antenna element 16, extending from the first side 50 to the second side 52 of the hearing instrument 2 during emission of the electromagnetic field.

Each of the further antenna elements 14, 16, including the second antenna element 14 and the third antenna element 16, have second sections 74, 76 extending from the first connecting region 22 along the first side 50 of the hearing instrument 2. Each of the further antenna elements 14, 16, including the second antenna element 14 and the third antenna element 16, have third sections 84, 86 extending from the second connecting region 23 along the second side 52 of the hearing instrument 2.

The first antenna element and the plurality of further antenna elements 14, 16, including the second antenna element 14 and the third antenna element 16, are wrapped into each other.

The first branch 18 of the first antenna element 13 and the second sections 74, 76 of the further antenna elements 14, 16 are arranged in a meandering form and/or shape. The second branch 20 of the first antenna element 13 and the third sections 84, 86 of the further antenna elements 14, 16 are arranged in a meandering form and/or shape.

The first branch 18 of the first antenna element 13 and the second sections 74, 76 of the further antenna elements 14, 16, are arranged in a coiled form, such as a spiral form, such as a helix form, such as a curled form, such as a twirled form, etc. The second branch 20 of the first antenna element 13 and the third sections 84, 86 of the further antenna elements 14, 16, are arranged in a coiled form, such as a spiral form, such as a helix form, such as a curled form, such as a twirled form, etc.

The first branch 18 of the first antenna element 13 and the second sections 74, 76 of the further antenna elements 14, 16 are arranged in a same coiled form, so that the first branch 18 of the first antenna element 13 and the second sections 74, 76 trace a same path. The second branch 20 of the first antenna element 13 and the third sections 84, 86 of the further antenna elements 14, 16 are arranged in a same coiled form, so that the second branch 20 of the first antenna element 13 and the third sections 84, 86 trace a same path.

The first branch 18 of the first antenna element 13 and the second sections 74, 76 of the further antenna elements 14, 16 are provided with consistent spacing along at least a part of the path. The second branch 20 of the first antenna element 13 and the third sections 84, 86 of the further antenna elements 14, 16 are provided with consistent spacing along at least a part of the path.

Figure 8:
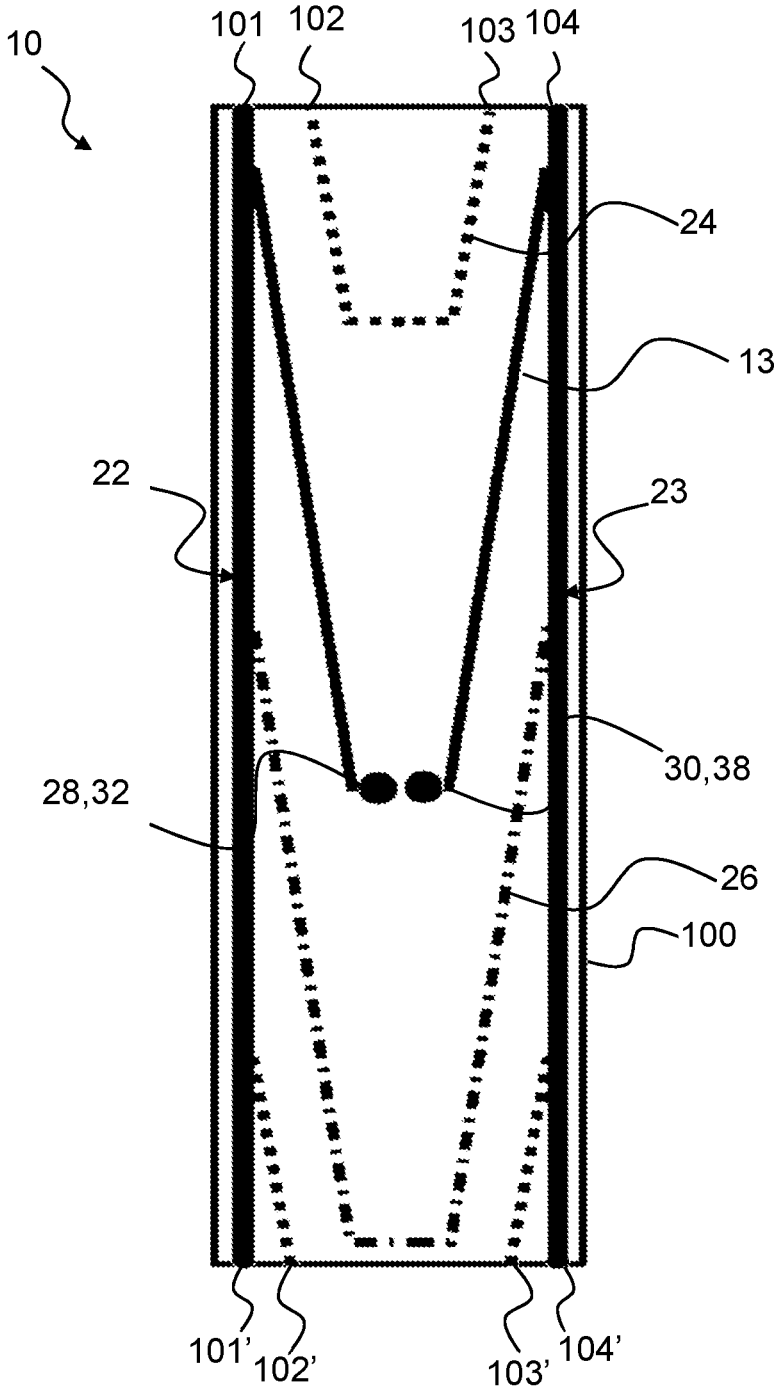

FIG. 8 schematically illustrates an antenna 10 configured for an in-the-ear type hearing instrument (not shown). Using a periodic boundary box 100, FIG. 8 shows the antenna 10 in a 2D pattern, configured for wrapping around a cylindrical structure to obtain a 3D structure. The boundary points 101, 102, 103, 104 in one end of the periodic boundary box connects to their respective counterparts 101', 102', 103',

104' in the opposite end of the periodic boundary box 100 to create a 3D structure. The antenna 10 comprises a first antenna element 13, a second antenna element 24 and a third antenna element 26. The first antenna element 13, the second antenna element 24 and the third antenna element 26 all connects in a first connecting region 22 and in a second connecting region 23, respectively. The antenna 10 is being fed through a first feed 28 at a first feed region 32 and at a second feed 30 at a second feed region 38, respectively.

Figure 9:
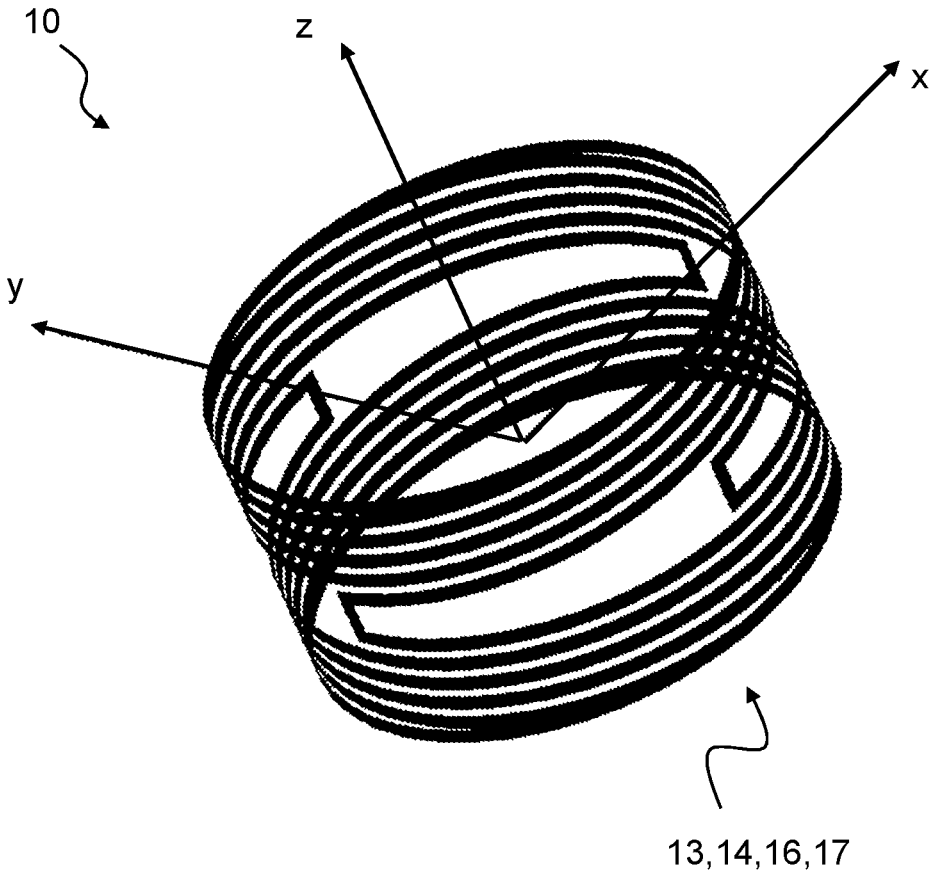

FIG. 9 illustrates an antenna 10 configured for an in-the-ear hearing instrument. The figure shows an antenna 10 in a 3D structure with a first antenna element 13 and a plurality of further antenna elements 14, 16, 17. The antenna 10 is configured for wrapping around e.g. a battery of the hearing instrument 2 and/or the electronics within the hearing instrument 2.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

LIST OF REFERENCES

2 hearing instrument
3 microphone
5 speaker
8 wireless communication unit
9 signal processor
10 antenna
11 power source
12 compensation filter
13 first antenna element
14, 16, 17 plurality of further antenna elements
18 first branch
20 second branch
21 substrate
22 first connecting region
23 second connecting region
14 second antenna element
16 third antenna element
17 fourth antenna element
28 first feed
30 second feed
32 first feed region
38 second feed region
40 first end of the first branch
42 first end of the second branch
43 first distance
48 second distance
50 first side
52 second side
54, 56 first section of each of the further antenna elements
58 third side
60 top side
64, 66 midpoint of each of the further antenna elements
74, 76 second section of each of the further antenna elements
84, 86 third section of each of the further antenna elements
100 periodic boundary box
101 first boundary point
102 second boundary point
103 third boundary point
104 fourth boundary point

The invention claimed is:

1. An electronic device comprising:

an antenna for electromagnetic field emission and/or electromagnetic field reception, the antenna having a first antenna element and a plurality of additional antenna elements, the first antenna element having a first branch and a second branch, the first branch having a first connecting region, and the second branch having a second connecting region;

wherein one or each of the plurality of additional antenna elements interconnects the first connecting region of the first branch of the first antenna element, and the second connecting region of the second branch of the first antenna element; and wherein the electronic device is configured to be in contact with a user during use by the user.

2. The electronic device according to claim 1, wherein one or each of the plurality of additional antenna elements forms a resonant antenna structure with the first antenna element.

3. The electronic device according to claim 1, wherein the plurality of additional antenna elements includes at least a second antenna element and a third antenna element.

4. The electronic device according to claim 1, wherein the first branch has a first feed of the antenna at a first feed region, and the second branch has a second feed of the antenna at a second feed region, the first feed region and the second feed region being along the first branch and the second branch, respectively.

5. The electronic device according to claim 4, wherein the first connecting region is separated from the first feed region by a first distance, and wherein the second connecting region is separated from the second feed region by a second distance, each of the first and second distances being measured along the first antenna element.

6. The electronic device according to claim 5, wherein the first distance and/or the second distance is between one eighth and three eighths of a wavelength of an electromagnetic field associated with the antenna.

7. The electronic device according to claim 1, wherein a length of the first antenna element or one of the additional antenna elements corresponds to half of a wavelength of an electromagnetic field associated with the antenna.

8. The electronic device according to claim 1, wherein the electronic device has a first side and a second side, and wherein the plurality of additional antenna elements comprises a second antenna element and a third antenna element.

9. The electronic device according to claim 8, wherein each of the second and third antenna elements extends from the first side to the second side.

10. The electronic device according to claim 8, wherein the first connecting region is located closer to the first side than to the second side, and wherein the second connecting region is located closer to the second side than to the first side.

11. The electronic device according to claim 8, wherein a midpoint of the second antenna element is located at a first section of the second antenna element extending from the first side to the second side.

12. The electronic device according to claim 8, wherein the first branch extends along the first side, and wherein the first connecting region is located closer to the first side than to the second side; and wherein the second branch extends along the second side, and wherein the second connecting region is located closer to the second side than to the first side.

13. The electronic device according to claim 8, wherein the second antenna element has a first section, and a second section extending from the first connecting region; and wherein the first branch of the first antenna element and the second section of the second antenna element are arranged in a meandering form.

14. The electronic device according to claim 8, wherein the second antenna element has a first section, and a second section extending from the first connecting region; and wherein the first branch of the first antenna element and the second section of the second antenna element are arranged in a coiled form.

15. The electronic device according to claim 14, wherein the coiled form comprises a spiral form, a helix form, or a curled form.

16. The electronic device according to claim 1, wherein the antenna has a configuration such that a current running through the antenna has a maximum amplitude in, or proximate to, a section of one of the additional antenna elements during electromagnetic field emission.

17. The electronic device according to claim 1, wherein the first branch and the second branch have a similar shape and/or form.

18. The electronic device according to claim 1, wherein the first antenna element and at least one of the plurality of additional antenna elements are wrapped with each other.

19. The electronic device according to claim 1, wherein the additional antenna elements are located in different planes.

20. The electronic device according to claim 1, further comprising:

a microphone for reception of sound and conversion of the received sound into a corresponding first audio signal;

a signal processor for processing the first audio signal into a second audio signal compensating a hearing loss of the user of the electronic device;

a speaker connected to an output of the signal processor for converting the second audio signal into an output sound signal; and a wireless communication unit configured for wireless data communication.

21. The electronic device according to claim 1, further comprising a wireless communication unit;

wherein the first branch and the second branch are connected with the wireless communication unit.

22. The electronic device according to claim 1, wherein the electronic device is configured for wear by a user.

* * * * *